US006588692B1

(12) United States Patent
Poncin

(10) Patent No.: US 6,588,692 B1
(45) Date of Patent: Jul. 8, 2003

(54) THROW SHOE FOR CENTRIFUGAL-TYPE CRUSHERS

(75) Inventor: Claude Poncin, Trooz (BE)

(73) Assignee: Magotteaux International (BE)

( * ) Notice: Subject to any disclaimer, the term of this patent is extended or adjusted under 35 U.S.C. 154(b) by 0 days.

(21) Appl. No.: 09/663,244

(22) Filed: Sep. 15, 2000

Related U.S. Application Data

(63) Continuation of application No. PCT/BE99/00034, filed on Mar. 16, 1999.

(51) Int. Cl.[7] ..... B02C 19/00
(52) U.S. Cl. ..... 241/301; 164/98; 241/275
(58) Field of Search ..... 241/275, 301; 164/98, 111

(56) References Cited

U.S. PATENT DOCUMENTS 3,044,720 A 7/1962 Bridgewater
3,149,793 A 9/1964 Bridgewater
3,346,203 A 10/1967 Danyluke
4,787,564 A 11/1988 Tucker
6,033,791 A * 3/2000 Smith et al. ..... 241/275
6,171,713 B1 * 1/2001 Smith et al. ..... 241/275

FOREIGN PATENT DOCUMENTS

WO WO 84/04760 12/1984
WO WO 89/04720 6/1989

* cited by examiner

*Primary Examiner*—Mark Rosenbaum
(74) *Attorney, Agent, or Firm*—Knobbe Martens Olson & Bear LLP

(57) ABSTRACT

Throw shoe with one or more pockets, which is intended for centrifugal-type crushers with a vertical shaft provided on its working face of a composite reinforcing structure (6) made of wear-resistant ceramic which has been infiltrated by an iron-based alloy and which is created in situ when the throw shoe is being cast.

18 Claims, 2 Drawing Sheets

THROW SHOE FOR CENTRIFUGAL-TYPE CRUSHERS

This is a continuation under 35 U.S.C. §371 of International Application PCT/BE99/00034, filed Mar. 16, 1999.

BACKGROUND OF THE INVENTION

1. Field of the Invention

The present invention relates to a throw shoe (also called impeller or impacter), which is intended for crushers of the centrifugal type with a vertical shaft i.e. the so-called VSI-crushers.

2. Description of the Related Art

The aforementioned VSI-crushers are known in the prior art for crushing all kinds of materials, especially rock aggregates. They are used, for example, in quarries and cement works. These VSI-crushers comprise a cylindrical housing or shell containing a turntable which is supported by a vertical bearing and which comprises means rotating the table about the central axis of the crusher. Furthermore, the crusher includes a series of throw shoes fixed to the turntable, as well as a series of anvils arranged on the internal vertical wall of the cylindrical housing, around the turntable.

Throw shoes are usually of a parallelepiped shape. They are generally made of cast iron, and are affixed to the turntable of the crusher. The face of the throw shoe which turned toward the axis of rotation of the table is called the nose of the throw shoe, while the face parallel to the anvils of the cylindrical housing forms the exit face of the throw shoe.

The front face of the throw shoe, called the working face, perpendicular to the axis of rotation of the table is that which the material to be crushed encounters.

This front working face of the throw shoe may be provided with one or more cavities which do not pass right through the structure of the throw shoe. These cavities form the so-called pockets of the throw shoe, which fill up i.a. with crushed material when the crusher is rotating.

During the crushing operation, the material to be crushed is poured into the center of the turntable by known means. Due to the effect of the centrifugal force and to the impact with the working face of the throw shoe, the material is thrown towards the anvils, against which it is crushed before it drops, in crushed form, to the bottom of the crusher from where it is removed through a discharge funnel. While the material is being thrown, the throw shoes are subjected to very high stresses and they are consequently subject to rapid wear.

The pockets in the throw shoes, because of the accumulation of material therein, allow a considerable increase of the lifetime of these throw shoes.

However, in this type of throw shoe, it is observed that the wear occurs preferentially around the exit edge of the pockets, i.e. at the point where the abrasion due to the material thrown by the centrifugal force is highest.

U.S. Pat. No. 3,044,720 (see column 6, lines 20–22 and FIGS. 5–8) describes a centrifugal-type impact crusher provided with a pocket which has a protection device in the form of a reinforcement consisting of separate plates or inserts which are attached to the impeller.

Similarly, for the same type of crusher, U.S. Pat. No. 3,149,793 (see column 2, lines 1–7 and FIGS. 2–7) also proposes separate reinforcing plates or inserts.

Document WO 84/04760 describes a wear and abrasion-resistant components used for i.a. crushers. The components can be assembled in the form of composites with a copper liner at the interface i.a. by casting in situ on or around a metallic substrate (see the abstract). Particulate carbides may be included in the said components which may be in suspension but are more likely to be fully dissolved in the melt (page 10, lines 17–26). A metallurgical bond is achieved by casting the alloy against a work surface of a substrate component (page 11, line 19) or by brazing to cause diffusion between the alloy and the substrate (page 12, lines 6–14).

In document WO 89/04720, ceramic tiles of the aluminium-oxide type for the exit ducts in anvil crushers have been proposed.

The technological background of the invention, in particular the design of the crushers may also be illustrated by U.S. Pat. Nos. 3,346,203 and 4,787,564.

All these references are incorporated by reference in the present description.

Attempts have also been made to attach a separate ceramic reinforcement, preferably made of tungsten carbide, to the edges of the pockets. This type of material resists the abrasion at the exit of the throw shoe very well.

Nevertheless, the wear produced is often localised along certain preferential paths, outside the initial cavities of the throw shoe. These preferential wear paths propagate over the entire structure of the throw shoe, the consequence of which is that eventually a piece is obtained in which practically only the reinforcement is intact.

Furthermore, when uncrushable materials, for example metallic materials, or larger size aggregate, are introduced into the crusher, these destroy the tungsten carbide ceramic reinforcement. When the reinforcement is broken, the turntable supporting the throw shoes operates in an unbalanced manner.

The throw shoes must then be removed and replaced, in order to avoid any vibration of the crusher.

SUMMARY OF THE INVENTION

The object of the present invention is essentially to avoid, or at least reduce, the drawbacks which result from the wear of the throw shoes of the prior art. A further object of the invention is to design a throw shoe which resists the impact of the particles to be crushed and which almost no longer suffers any deterioration in its initial structure.

Accordingly, a throw shoe is provided for centrifugal-type crushers with a vertical shaft of the VSI-type which comprises on its working face a composite reinforcement structure which is formed from a wear-resistant ceramic material which has been infiltrated by an iron-based alloy, said composite reinforcement structure being solid cast with the body of the throw shoe which is constituted by the same iron-based alloy.

The technique for producing said throw shoe consists in the steps of placing a wear-resistant ceramic material in a mold and performing a casting operation wherein said wear-resistant ceramic is infiltrated by a liquid iron-based alloy and simultaneously, in situ, solid cast with the material constituting the remaining part of the throw shoe, thus producing an integral structure including a reinforcement on the working surface in the body of the throw show.

A key feature of the present invention resides in the choice of a composite formed by an iron-based alloy (steel or cast iron) and a ceramic material in order to constitute the reinforcing element, which is formed in situ while the throw shoe is being cast.

The starting material for the composite reinforcement structure according to the invention are very wear-resistant ceramic particles preferably based on alumina and/or zirconia or on alumina-zirconia, which are agglomerated by a binding agent. During casting, said agglomerated ceramic particles are infiltrated by the same liquid metal serving to form the body of the throw shoe including the composite reinforcement structure as a part cast solid with the body of the throw shoe.

Similarly to the usual constitution of throw shoes for VSI-crushers, the throw shoes according a first embodiment of the invention may comprise one or more cavities or pockets and said composite reinforcement is tailored to the number, the size and the geometrical shape of the pocket or pockets and is located around the periphery of the pocket or pockets.

However it appeared that an equally if not more favorable solution may consist according to a second embodiment of this invention in throw shoes which initially do not comprise such cavities or pockets. In such case the said composite reinforcement structure is tailored to the number, the size and the geometrical shape of the pocket or pockets to be formed in service by wear-out and become located around the periphery of such pocket or pockets.

The body of the throw shoe in such case due to the absence of pockets will be initially flush with the reinforcement structure on the front working face of the throw shoe. In service however the non-reinforced zones will wear out and pockets will be naturally formed in the zones where reinforcement is absent on said working face.

According to a method for producing such throw shoe according to the above first embodiment of the invention, a reinforcement made of a wear-resistant ceramic composite is formed around the cavities constituting the pockets so as to obtain protection not only along the exit edge of the throw shoe but also around the contour of the pocket or pockets. Therefore, after placing the ceramic material as ceramic particle agglomerated by a binding agent on the bottom of a mold according to a specific pattern in relationship to the walls of the pockets, and placing one or more cores to provide one or more cavities in the casting, liquid iron-based alloy is cast into the mold. The first part of the iron based liquid alloy will first infiltrate the ceramic material, thus creating the composite reinforcement structure around the periphery of the cavities and, after the ceramic material has been fully impregnated will form, with said reinforcement, the body of the throw shoe surrounding the walls of the pockets, thus forming a solid composite throw shoe after cooling.

In service the pockets will be filled up by the material undergoing crushing.

In this way, the entire structure of the throw shoe is protected from abrasion by the material to be crushed without the necessity of using separate attached pieces. Likewise, an appropriate structure of the reinforcement, suitable for a defined number of pockets of defined geometrical shape and size, allows the material in the pocket or pockets to be centered and thus prevents the problems of preferential wear.

A method for producing a throw shoe according to the above second embodiment of the invention consists in placing the ceramic material as ceramic particles agglomerated by a binding agent on the bottom of a mold, according to a specific pattern and to cast the liquid iron based liquid alloy into the mold in the same manner as in the first method, but without the presence of one or more sand cores. Initially therefore, a throw shoe without any cavity will be obtained, having a substantially flat surface but including on said surface, a composite reinforcement structure disposed in accordance with the selected specific pattern chosen for the ceramic material.

In such case, due to the local absence of the reinforcement structure on the work surface, the unprotected areas will in the beginning undergo a rapid wear-out effect, thus creating naturally pockets in the throw shoe. This is however possible because the reinforcement structure is integral with the body of the throw shoe and is sufficiently wear-resistant.

Several advantages can be observed by this method compared by the technique involving the use of one or more sand cores.

The first advantage is due to the fact that more metal is available for the infiltration of the ceramic material, while in the method using one or more cores, only the metal intended to form the walls of the pockets was available.

Thicker reinforcement structures may thus be obtained.

It also appeared that when starting the crusher with new throw shoes comprising pockets, thus in absence of ground material accumulated into the shoe, the relatively thin walls of the pockets are directly subjected to the impact of rock aggregates, metallic foreign pieces etc., and are easily deteriorated. When initially the pockets are not yet ground out, the shoe is more impact resistant.

The initial wear out necessary to produce the pockets increases substantially by the lifetime in service of the throw shoe. Once the wear has started however the pockets being formed are filled up with material being crushed and further wear progresses only slowly.

A further advantage which is observed is that the wear profile can be more easily controlled because the shape of the pockets, appearing during the wear-off, is more predictable due to the protecting conferred by the composite reinforcement structure, even if the material to be crushed is modified in operation i.e. if the particle size or the abrasive nature of the material changes during the operation of the crusher.

The shape of the intended pockets to be formed by wear-out may thus be easily changed by a selection of the shape of the reinforcement structure without necessitating undue modification of the cast models and without necessitating the use of core boxes.

Finally, the increased costs due to the use of supplementary material resulting from the absence of pockets in largely compensated by the increase of lifetime of the throw shoes, the easier production thereof and the fact that core boxes are not necessary to obtain pockets.

Other objectives, features and advantages of the present invention will be more easily understood upon consideration of the following description of preferred embodiments of the invention taken in conjunction with the accompanying drawings.

DETAILED DESCRIPTION OF THE PREFERRED EMBODIMENT

Figure 1:
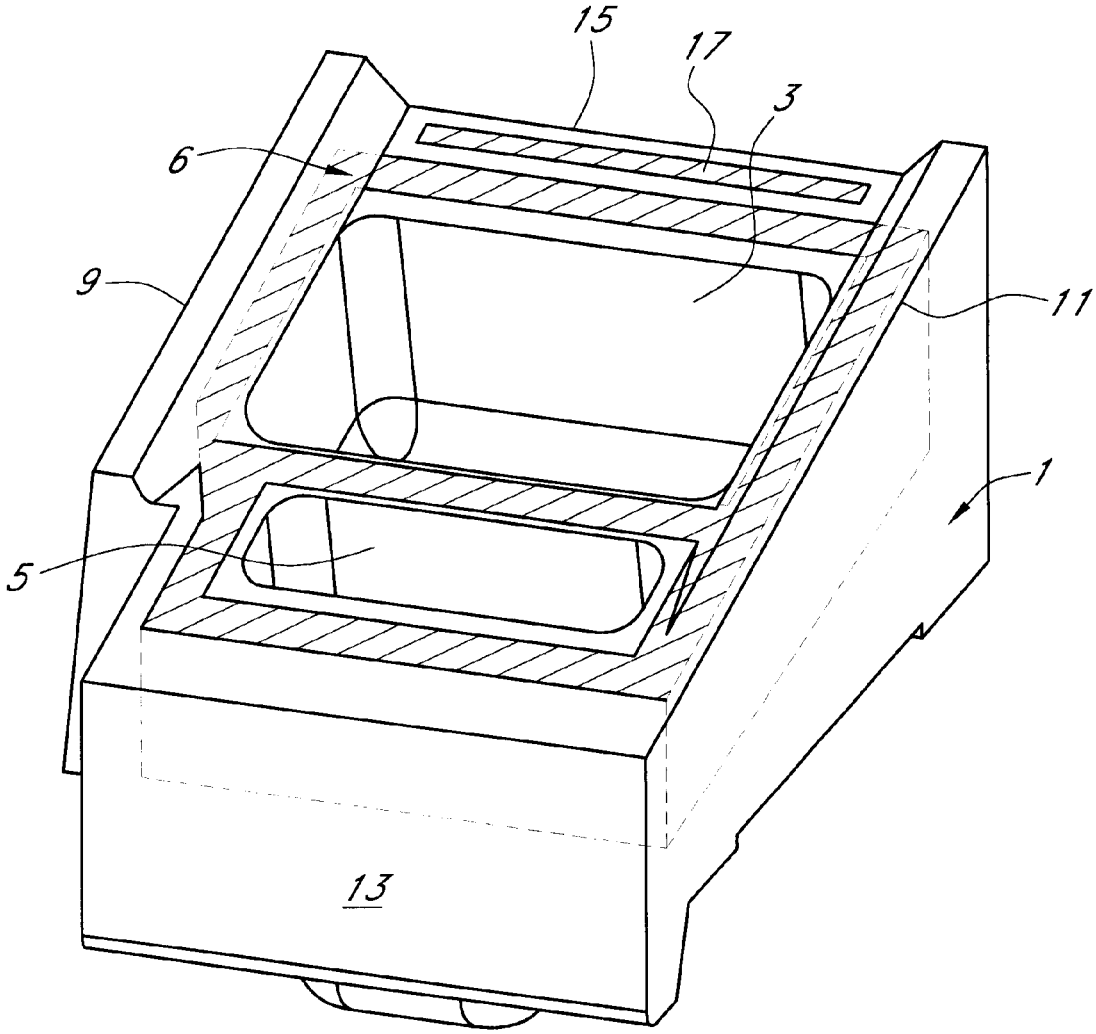
FIG. 1 shows a perspective view of a throw shoe with two pockets according to the invention.

FIG. 1 illustrates diagrammatically the throw shoe according to the invention, bearing the general reference 1, with two pockets 3 and 5, comprising the composite reinforcement structure identified by the general reference 6 and shown in hatched lines.

This composite reinforcement is preferably made from an agglomerate of ceramic particles based on alumina-zirconia and a binding agent. These ceramic particles are manufactured conventionally by electrofusion, by sintering, by thermal spraying or by any other process allowing the two constituents alumina and zirconia to be fused together.

The structure of the composite reinforcement is produced around the periphery of the pockets of the throw shoe at a minimum distance of 5 mm from the edges of the pockets, thus preventing a throw shoe from wearing at the lower edge 9 and the upper edge 11, as well as at the nose 13 and the exit 15 of the throw shoe.

A complementary reinforcing structure 17 (also shown in hatched lines) may be provided on the exit face of the throw shoe 1.

As illustrated, the composite reinforcing structure does not necessarily have to be placed over the entire width, length or depth of the throw shoe in order to prevent deterioration of the structure.

The geometry of the structure of the composite is tailored to the geometrical configuration of the throw shoe, this configuration being chosen depending on the material to be crushed.

The particular configuration of the composite structure as illustrated was chosen so as, on the one hand, to limit wear of the entire piece of the throw shoe and, on the other hand, to allow easy production of the throw shoe provided in situ with the reinforcing structure when the throw shoe is being cast.

The throw shoe therefore consists of a heterogeneous element, but without separate reinforcement parts. This throw shoes has, in the regions predominantly exposed to wear, a. reinforcement integrated into the throw shoe in the form of a structure based on a composite which is formed from an iron-based alloy (steel or cast iron) on the one hand and a ceramic material having the property of wear-resistance for the envisaged uses, on the other.

Figure 2:
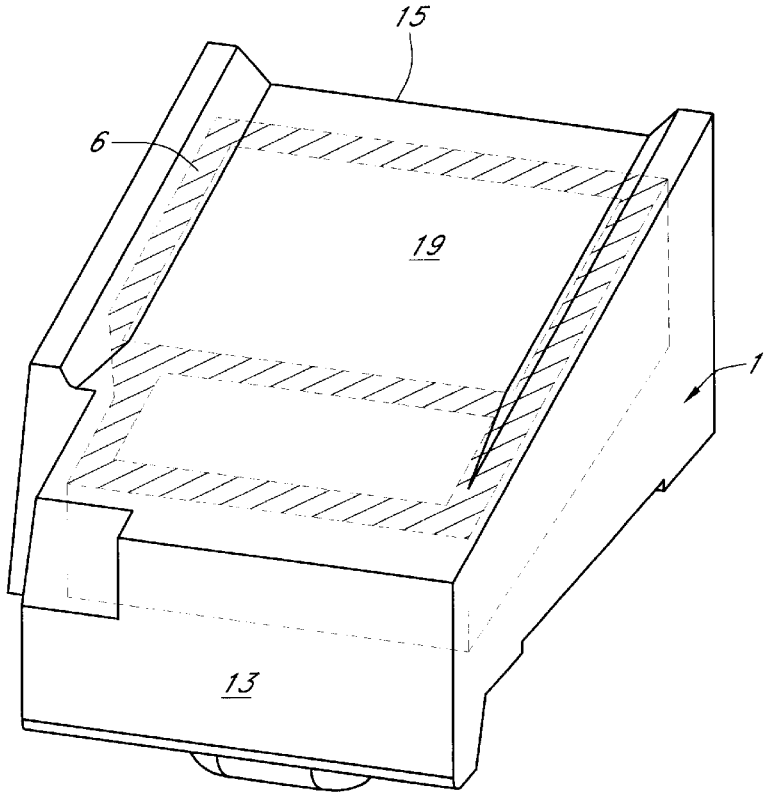
FIG. 2 shows a perspective view of the throw shoe without any pocket but where the reinforcement structure is provided to form two pockets by wear out.

FIG. 2 is substantially similar to FIG. 1 but the throw shoe 1 on its working surface 19 does not comprise any pocket. Thus, the upper part of the composite reinforcement structure 6 is flush with the working face of the throw shoe.

Figure 3:
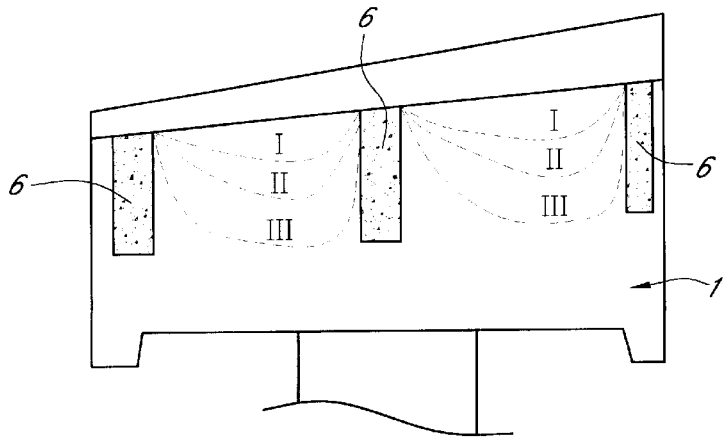
FIG. 3 illustrates in a sectional longitudinal view the evolution of the profile of the pockets being formed in service.

The configuration of the structure 6 has however been selected in such a manner that wear-out on the working face 19 will cause the formation of two pockets inside the periphery of the structure 6. This is illustrated by FIG. 3 where the progressive formation of these pockets is indicated by the lines I, II and III.

In the case of the embodiment of FIG. 1, the thickness of the partition of the structure 6 between the two pockets 3 and 5 is limited by the necessity to homogeneously infiltrate the ceramic material by liquid alloy during casting. The equivalent portion of the reinforcement structure in the case of FIG. 2 is not subjected to this difficulty since a result of the absence of cores for forming the pockets more liquid metal is available.

In the both embodiments which have been described, the body proper of the throw shoe is thus made of an iron-based alloy and the reinforcement part therein is made out of a matrix of this alloy including ceramic particles, reinforcement being an integral part of the body.

EXAMPLE

A throw shoe with two pockets and a composite reinforcement, as shown in FIG. 1, was compared with an identical throw shoe without a composite reinforcement in an application involving the crushing of rhyolite having an incoming particle size of between 3 and 40 mm.

The lifetime of the throw shoe with a composite reinforcement is twice that obtained with equivalent throw shoes without this reinforcement.

In the case of a throw shoe as in FIG. 2 which initially does not comprise preformed pcokets, the lifetime was faster increased by a value of the order of 50% compared to the embodiment of FIG. 1.

What is claimed is:

1. A throw shoe for centrifugal-type crushers which comprises:

a body formed of an iron-based alloy and having a working face wherein said working face is exposed to contact with material to be crushed;

a composite reinforcement structure formed on said working face, said composite reinforcement structure being solid cast with said body, wherein said composite reinforcement structure comprises a wear-resistant ceramic material infiltrated by the same iron-based alloy as that of said body, wherein said composite reinforcement material is flush with the working face, wherein said composite reinforcement structure is tailored to be located around the periphery of at least one pocket that is to be formed on said working face by abrasion resulting from contact with the material to be crushed during service, wherein the at least one pocket is configured to hold the crushed material in a manner such that the crushed material provides reinforcement to the throw shoe.

2. Throw shoe according to claim 1, wherein said composite reinforcing structure is tailored to the number, the size and the geometrical shape of the at least one pocket.

3. Throw shoe according to claim 1, wherein the ceramic material constituting the reinforcing structure is produced from ceramic particles based on alumina-zirconia agglomerated by a binding agent.

4. Throw shoe according to claim 1 wherein composite reinforcing structure is located at a minimum distance of 5 mm from the edge of the at least one pocket.

5. A method for producing a throw shoe having an integral reinforcement structure comprising the steps of:

placing a wear-resistant ceramic material in a mold;

performing a casting operation wherein said wear-resistant ceramic material is infiltrated by a liquid iron-based alloy and simultaneously, in situ, solid cast with a casting material so as to form an integral structure comprising of a throw shoe having a body and a working surface, wherein the working surface is exposed to contact with material to be crushed, wherein selected areas of the body and the working surface are reinforced by the wear-resistant ceramic material, wherein the wear-resistant ceramic material is tailored to be located around the periphery of at least one pocket that is to be formed on said working surface by abrasion resulting from contact with the material to be crushed during service, wherein the at least one pocket is configured to hold the crushed material in a manner such that the crushed material provides reinforcement to the throw shoe.

6. A method for producing a throw shoe having at least one pocket defined by a plurality of walls, comprising the steps of:

placing ceramic particles agglomerated by a binding agent on the bottom of a mold according to a specific pattern in relationship to the walls of the at least one pocket;

placing at least one core to provide at least one cavity for casting;

performing a casting operation wherein said ceramic particles are infiltrated by a liquid iron-based alloy and simultaneously, in situ, solid cast with a casting material so as to form an integral structure comprising of a throw shoe having a body and a working surface wherein selected areas of the body and working surface are reinforced by the wear-resistant ceramic material, wherein the wear-resistant material is tailored to be located around the periphery of the at least one pocket, wherein the at least one pocket is configured to hold the crushed material in a manner such that the crushed material provides reinforcement to the throw shoe.

7. Method for producing the throw shoe of claim 6 wherein placing the ceramic particles according to a specific pattern in relationship to the walls of the at least one pocket comprises placing the ceramic particles according to the specific pattern in relationship to the walls of the at least one pocket that will be formed on the working surface by abrasion resulting from contact with the material to be crushed during service.

8. A throw shoe for a centrifugal-type crushing apparatus, comprising:

a body designed to project material to be crushed laterally outward, wherein the body has a working face that is exposed to contact with material to be crushed;

an integral reinforcement structure wherein said reinforcement structure comprises a wear-resistant composite material wherein said composite material, being solid cast with the body, is integrated into selected areas of the body during formation of the throw shoe, wherein said composite material is integrated into said working face so as to reinforce said working face and protect said working face from abrasions caused by the material to be crushed, wherein said composite material is tailored to be located around the periphery of at least one pocket that is to be formed on said working face by abrasion resulting from contact with the material to be crushed during service, wherein the at least one pocket is configured to hold the crushed material in a manner such that the crushed material provides reinforcement to the throw shoe.

9. The throw shoe of claim 8 wherein said body comprises an iron-based alloy and said reinforcement structure comprises a wear-resistant ceramic material, infiltrated by the iron-based alloy.

10. The throw shoe of claim 9 wherein said ceramic material comprises a alumina based material agglomerated by a binding agent.

11. The throw shoe of claim 8 wherein the throw shoe is designed for centrifugal-type crushers with a vertical shaft of the VSI-type.

12. A method of forming a throw shoe for a crushing apparatus, the method comprises:

placing a wear-resistant ceramic material in a mold wherein the ceramic material is positioned to reinforce the periphery of a pocket region that is to be formed on the throw shoe;

infiltrating the ceramic material with an iron-based alloy so as to form a composite material;

performing a casting operation wherein the ceramic material is solid cast with additional iron-based alloy so as to form a throw shoe having an integrally formed reinforcement region around the periphery of the pocket region wherein the reinforcement region comprises of the composite material.

13. The method of claim 12 wherein placing the ceramic material in the mold comprises placing a zirconia-based material agglomerated in a binding agent.

14. The method of claim 12 wherein performing the casting operation further comprises placing a core into the mold so as to provide a cavity in the casting wherein the cavity forms the pocket region of the throw shoe.

15. The method of claim 12 wherein the pocket region is to be formed by abrasion resulting from contact with the material to be crushed during service.

16. A throw shoe for centrifugal-type crushers comprising:

a body formed of an iron-based alloy having a working face wherein said working face is exposed to contact with material to be crushed;

a non-reinforced zone on the working surface, wherein at least one pocket is to be formed in the non-reinforced zone by abrasion resulting from contact with the material to be crushed during service;

a reinforced zone on the working surface, wherein the reinforced zone is flush with the working surface; wherein the reinforced zone comprises a composite reinforcement structure being solid cast with said body, wherein said composite reinforcement structure comprises a wear-resistant ceramic material infiltrated by the same iron-based alloy as that of said body; wherein the reinforced zone is configured to be positioned on the periphery of the at least one pocket, wherein the at least one pocket is configured to hold the crushed material in a manner such that the crushed material provides reinforcement to the throw shoe.

17. The throw shoe of claim 16 wherein the reinforced zone is tailored to the number, the size and the geometrical shape of the at least one pocket.

18. The throw shoe of claim 16 wherein the composite reinforcement structure comprises ceramic particles based on alumina-zirconia agglomerated by a binding agent.

* * * * *